US007810216B2

(12) United States Patent
Zubiaurre et al.

(10) Patent No.: US 7,810,216 B2
(45) Date of Patent: Oct. 12, 2010

(54) HANDLE CONNECTION FOR A MANUAL UTENSIL OR TOOL

(76) Inventors: Pedro Jose Zubiaurre, Poligono Ibaitarte, Pabellon A-7, 20870 Elgoibar (Gipuzkoa) (ES); Manuel M Zubiaurre, Poligono Ibaitarte, Pabellon A-7, 20870 Elgoibar (Gipuzkoa) (ES)

( * ) Notice: Subject to any disclaimer, the term of this patent is extended or adjusted under 35 U.S.C. 154(b) by 409 days.

(21) Appl. No.: 11/345,053

(22) Filed: Feb. 1, 2006

(65) Prior Publication Data

US 2006/0123601 A1 Jun. 15, 2006

Related U.S. Application Data

(63) Continuation-in-part of application No. PCT/ES2004/000449, filed on Oct. 19, 2004.

(30) Foreign Application Priority Data

Jan. 10, 2004 (ES) ..... 200402342
Jan. 10, 2004 (ES) ..... 200402343

(51) Int. Cl.
*B25G 1/10* (2006.01)

(52) U.S. Cl. ..... 16/436; 16/110.1

(58) Field of Classification Search ..... 16/110.1, 16/436; 173/162.1–162.2
See application file for complete search history.

(56) References Cited

U.S. PATENT DOCUMENTS 191,073 A * 5/1877 Roberts ..... 403/248
521,861 A 6/1894 Zeiser et al.
1,342,929 A * 6/1920 Shepard ..... 403/248
1,399,172 A * 12/1921 Vaughan ..... 403/250
1,445,470 A * 2/1923 Bale ..... 403/250
1,497,711 A * 6/1924 Cox ..... 403/250
1,500,132 A * 7/1924 Hummelgard ..... 294/51
1,518,259 A * 12/1924 Filiatreault ..... 16/422
2,198,783 A * 4/1940 McAllister ..... 15/104.05
2,202,863 A * 6/1940 Plon ..... 403/259
2,297,577 A * 9/1942 Monte ..... 43/23
2,396,040 A * 3/1946 Darling ..... 74/126
2,397,106 A * 3/1946 Haller ..... 91/168

(Continued)

FOREIGN PATENT DOCUMENTS

BE 1011505 A6 10/1999

(Continued)

*Primary Examiner*—Victor Batson
*Assistant Examiner*—Roberta Delisle
(74) *Attorney, Agent, or Firm*—Lucas & Mercanti, LLP

(57) ABSTRACT

A handle connection for a manual utensil or tool, whereby the implement (2) has a biconical through-hole and there is a handle head (1) on the handle with an exterior surface that matches the surface of the hole in which it is inset. The handle head (1) presents an interior hole (40), at the outlet (31) of which in the outgoing angle zone ($Z_2$) there is a wedge (5) that, when pressure is applied to this outgoing angle zone ($Z_2$), makes the zone fit flush with the hole. It has a fastening screw (7), the body of which (16) passes through the wedge (5), and it is screwed by threads (15 and $\mathbf{15}_1$) directly/indirectly to the head of the handle (1), which screw has a head (9) that directly/indirectly abuts against the implement (2) such that the head of the handle (1) works like a nut with respect to the fastening screw (7).

19 Claims, 5 Drawing Sheets

U.S. PATENT DOCUMENTS

| | | | | | |
|---|---|---|---|---|---|
| 2,400,207 | A | * | 5/1946 | O'Farrell et al. | 173/18 |
| 2,461,886 | A | * | 2/1949 | Filiatreault, Jr | 16/110.1 |
| 2,465,483 | A | * | 3/1949 | Roberts | 403/250 |
| 2,618,986 | A | * | 11/1952 | Hungerford | 74/551.9 |
| 2,658,766 | A | * | 11/1953 | Rock | 279/96 |
| 2,754,158 | A | * | 7/1956 | Bazzett | 403/409.1 |
| 2,869,882 | A | * | 1/1959 | Zimmerman | 279/23.1 |
| 3,024,682 | A | * | 3/1962 | Finkle | 81/476 |
| 3,129,737 | A | | 4/1964 | Citroen | |
| 3,665,581 | A | * | 5/1972 | Gulistan | 29/243.529 |
| 3,704,734 | A | * | 12/1972 | Soto et al. | 81/22 |
| 4,027,644 | A | * | 6/1977 | Timour | 123/198 E |
| 4,321,040 | A | * | 3/1982 | Miller et al. | 433/102 |
| 4,367,969 | A | * | 1/1983 | Carmien | 403/253 |
| 4,471,842 | A | * | 9/1984 | Fox | 172/377 |
| 4,516,615 | A | * | 5/1985 | Finn | 81/20 |
| 4,577,450 | A | * | 3/1986 | Large | 52/787.12 |
| 4,711,594 | A | | 12/1987 | Agee | |
| 4,732,519 | A | * | 3/1988 | Wagner | 411/337 |
| 4,753,137 | A | | 6/1988 | Kennedy | |
| 5,056,208 | A | * | 10/1991 | Stafford | 29/515 |
| 5,255,647 | A | * | 10/1993 | Kiczek | 123/195 C |
| 5,259,714 | A | * | 11/1993 | Campbell | 411/34 |
| 5,397,206 | A | * | 3/1995 | Sihon | 411/544 |
| 5,933,916 | A | * | 8/1999 | Loschelder | 16/110.1 |
| 6,059,503 | A | * | 5/2000 | Johnson | 411/353 |
| 6,227,784 | B1 | * | 5/2001 | Antoine et al. | 411/369 |
| 6,234,734 | B1 | * | 5/2001 | Klippel | 411/42 |
| 6,308,726 | B2 | * | 10/2001 | Sato et al. | 137/15.14 |
| 6,349,451 | B1 | * | 2/2002 | Newman et al. | 16/427 |
| 6,490,761 | B2 | * | 12/2002 | Durrant | 16/436 |
| 6,547,500 | B2 | * | 4/2003 | Cosenza et al. | 411/34 |
| 6,564,849 | B1 | * | 5/2003 | Kusner | 157/1.3 |
| 6,582,172 | B2 | * | 6/2003 | Nickerson et al. | 411/371.1 |
| 6,607,328 | B1 | * | 8/2003 | Treiber et al. | 403/408.1 |
| 6,617,523 | B1 | * | 9/2003 | McClain et al. | 174/260 |
| 6,681,658 | B1 | * | 1/2004 | O'Neal et al. | 81/45 |
| 2002/0020041 | A1 | * | 2/2002 | Newman et al. | 16/427 |

FOREIGN PATENT DOCUMENTS

| | | |
|---|---|---|
| DE | 3307969 | 9/1984 |
| GB | 211041 | 2/1924 |
| GB | 393154 | 6/1933 |

* cited by examiner

HANDLE CONNECTION FOR A MANUAL UTENSIL OR TOOL

CROSS REFERENCE TO RELATED APPLICATIONS

This is a Continuation-in-part of International Application PCT/ES2004/000449 filed Oct. 19, 2004 which, in turn, claimed the priority of Spanish Applications P-200402342 filed Oct. 1, 2004 and P-200402343 filed Oct. 1, 2004, the priority of all three claimed herein and the disclosure of all three are incorporated herein by reference.

BACKGROUND OF INVENTION

1. Field of Invention

This invention relates to hand tools and, more particularly, to a connection assembly between the handle and the head of the tool.

2. Art Relating to Invention

Manual implements, utensils, tools or instruments have a handle that must be connected to the implement-tool assembly, examples of such tools are hammers, brooms, screwdrivers, axes, adzes, oars, canes, pans, culinary utensils, etc.

The connection between the handle and the implement (head) deteriorates with use and continuous banging, thereby causing damaging wear and gaps between the implement and the handle.

In order to solve this problem, BE 1011505, and others, use an adjustment screw between the implement and the handle.

In solutions known up to now, there is a problem of lack of control of the pressures/deformations on the head of the handle where it fits in both the upper zone of the hole of the implement and in the lower zone at the outlet of the hole.

Another, very serious problem appears as a result of the undesirable deformations suffered by the hole/adjustment screw when the head of the handle is inserted into the implement.

SUMMARY OF THE INVENTION

The applicant solves the stated problems by creating a third element of a metallic nature that is fastened to the top of the head of the handle, thereby partially occupying its transversal section, whereby the desired deformations on the material of the handle's head are obtained.

Likewise, a hole in this third element remains isolated from the exterior, without becoming deformed due to pressures between the handle and the implement.

This invention provides: an adjustable and/or precision connection between the handle and the implement; the connection is maintained without gaps after use and banging over time; the connection is capable of being regulated-tightened; and the connection is highly safe, by preventing detachment of the handle from the implement.

By using the connection of the invention, the useful life of the implement is extended and its features are maintained over time, just like the first day it was used.

Specifically, the handle connection for manual utensils or tools of the invention is characterized by:

(a) a handle for an implement, said handle having a non-metallic head;

(b) the implement has a hole in which the head of the handle is inserted, thereby leaving the end of the handle free;

(c) a third, metallic and non-deformable element fastened to the top of the head of the handle, thereby partially occupying a transversal section of the head of the handle and being completely contained within a head of the handle; and (d) a fastening screw, the body of which is joined to the third element and the screw has a head that directly/indirectly abuts against the implement, thereby establishing a male-female relationship between the third element and the fastening screw such that the third element can move longitudinally, thus pulling the head of the handle with it and thereby insetting it into/fitting the handle into the hole of the implement.

It is also characterized because the head of the fastening screw indirectly abuts against the implement by means of a stop washer fitted in an inset made in the outlet of the implement through which it passes.

It is also characterized because the implement and the third element are metallic and the head of the handle is non-metallic.

It is also characterized because the through hole and the head of the handle are fitted together, with a completely hermetic and water-tight seal.

It is likewise characterized because of the following:

(a) the implement has a hole, which is preferably a through-hole, that consists of an inlet zone and an outlet zone, which preferably converge on each other;

(b) the handle has a handle head with an incoming angle zone and an outgoing angle zone; the exterior surface of the incoming angle zone matches the corresponding surface of the inlet zone of the hole, and the exterior surface of the outgoing angle zone matches the corresponding surface of the outlet zone of the hole;

(c) the handle head has an interior hole equipped with a wedge at the outlet of the outgoing angle zone, which, when pressure is placed on the outgoing angle zone, by the wedge, makes the surface of the outgoing angle zone fit flush with the corresponding outlet zone of the hole in which it is inserted;

(d) the fastening screw whose body passes through the wedge, is directly screwed to the third metallic element, the screw has a head that directly/indirectly abuts against the implement such that the head of the handle works like a nut with respect to the fastening screw.

It is also characterized because it is equipped with initial mechanical means of traction between the head of the fastening screw and the implement or elements directly/indirectly joined to the implement.

It is also characterized because the head of the fastening screw indirectly abuts against the implement by means of a wedge.

It is also characterized because the head of the fastening screw indirectly abuts against the implement by means of a stop washer fitted in the implement at the outlet of the through-hole.

It is also characterized because it is equipped with the initial mechanical means of traction between the head of the fastening screw and the wedge.

It is also characterized because it is equipped with the initial mechanical means of traction between the head of the fastening screw and the stop washer.

It is also characterized because there are secondary mechanical means of traction between the wedge and the stop washer.

This connection effectively resolves the stated problems of handle-implement connections.

The connection is fitted along the entire contact surface of the conical or biconical head of the handle (after the pressure by the wedge) and in the conical or biconical through-hole of the implement, with blocking and traction forces (in the opposite direction) between the male-female elements of a conical connection or in both biconical connections. It is preferable that these traction forces be constant.

In order to understand the object of this invention better, the drawings present the preferred way of practical execution, which may be subject to accessory changes that do not detract from its basic structure.

DETAILED DESCRIPTION OF THE INVENTION

A non-restrictive example of a practical execution of the invention is described below.

The implement performs the female function, and therefore it has a hole (11) in which the head of the handle (1) is inset, which performs the male function. The hole (11) can be a through-hole (FIG. 1) or not (FIG. 2).

The surface area of the hole (11) and the exterior surface area of the head of the handle (1) are matched and fitted perfectly to each other, for example, because they both have been precision machines.

The fit between both surfaces is perfect.

The surface of the hole (11) is convergent, meaning that the surface of its cross-section decreases throughout the hole, wherefore this section may have any shape: circular, elliptical or polygonal.

Figure 1:
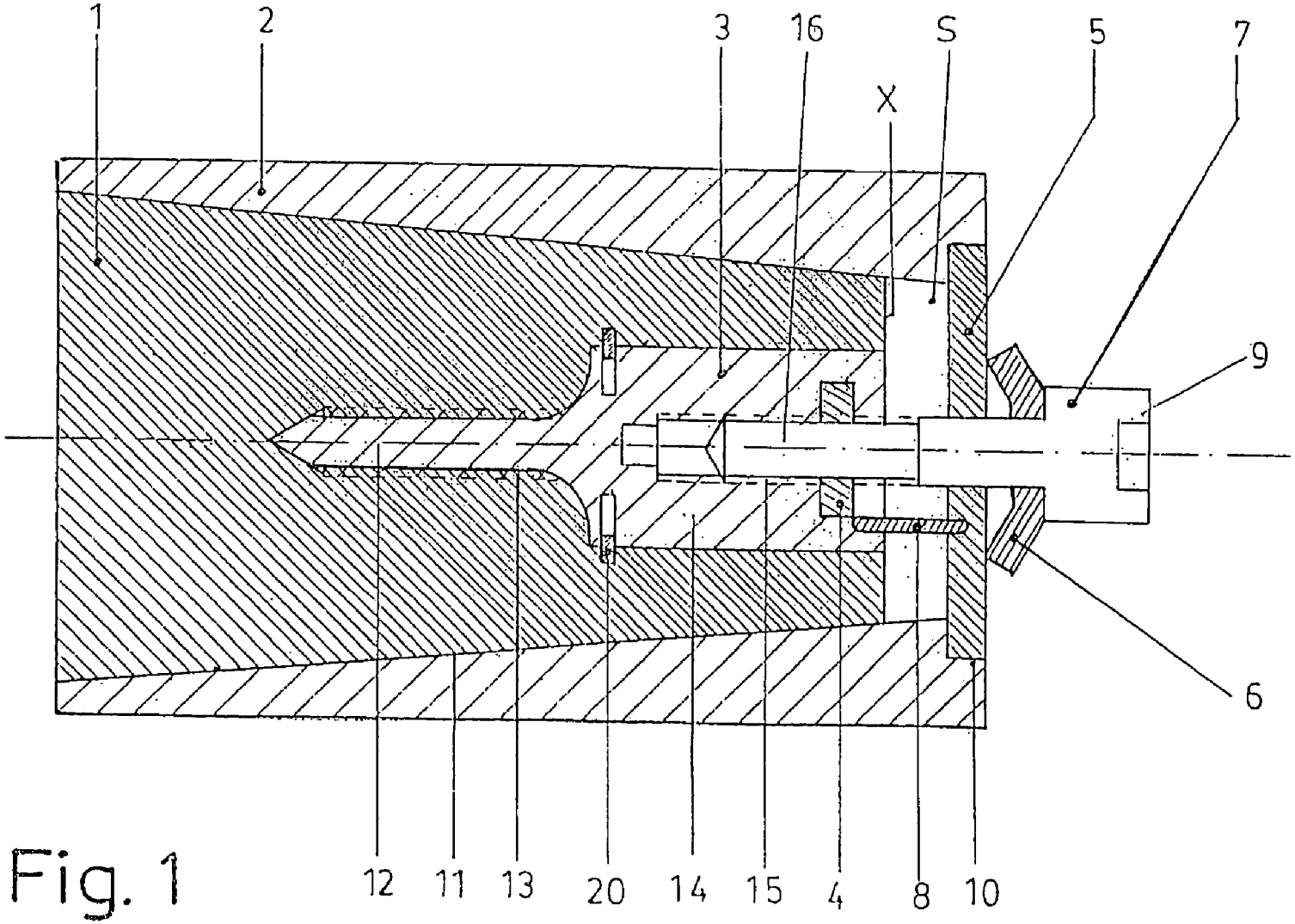
FIG. 1 is a longitudinal, cross-section view of a practical execution of the connection, object of the invention.
Figure 2:
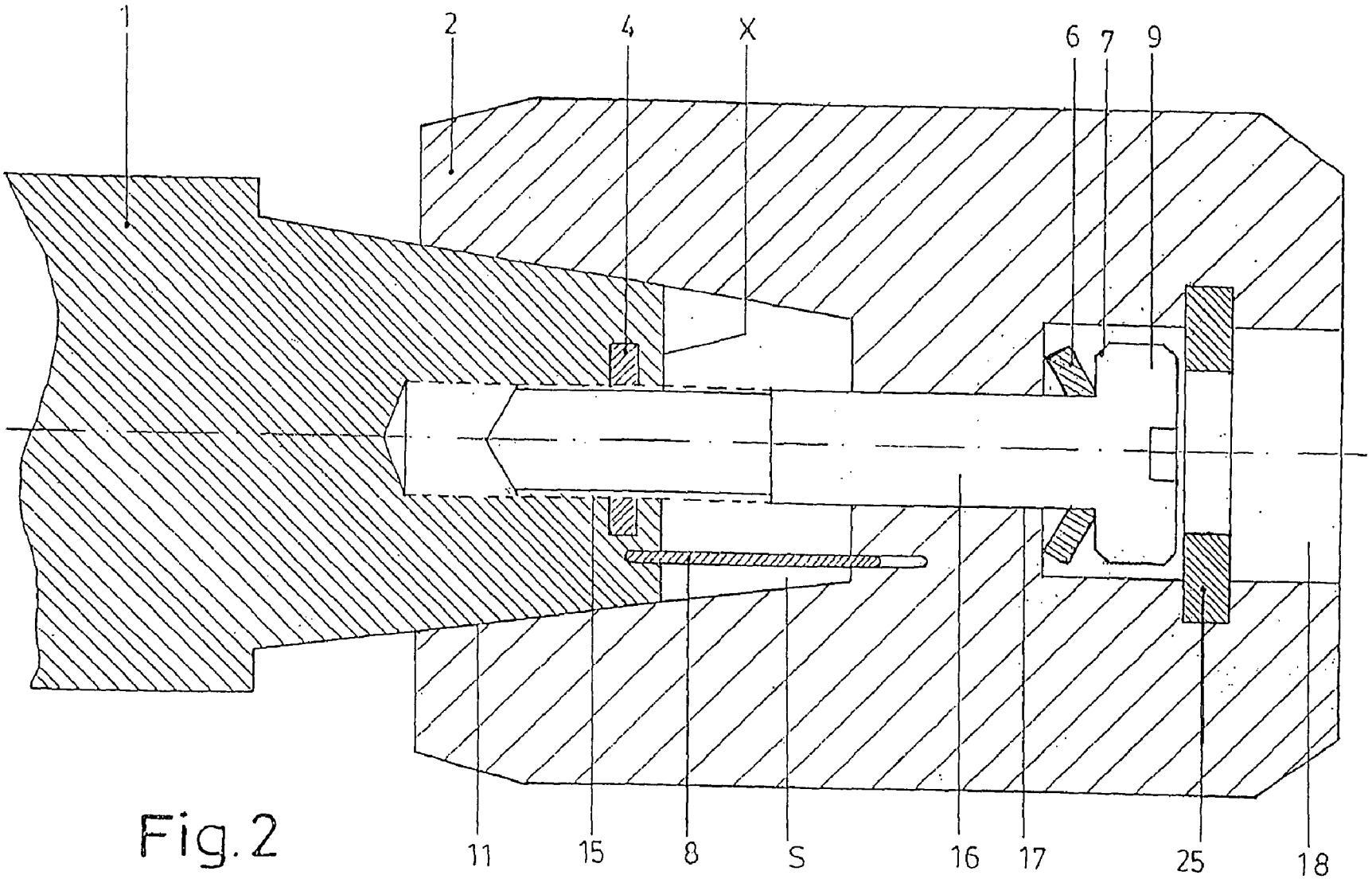
FIG. 2 is a longitudinal, cross-section view of another practical execution of the object of the invention.

It can be observed in FIG. 1 that at the outlet of the through-hole (11), a stop washer (5), for example, is fastened to the implement (2) by fitting it into a fixed inset (10).

There is a fastening screw (7) for joining the head of the handle (1) to the implement (2), wherefore it is equipped with a third element (3) (a pull shaft), which is fastened to the head of the handle (1), for example, by screwing in threads (13) of a pointed projection (12), which penetrates deeply into the head of the handle (1), or by any other conventional means. The third element (3) is contained within the head of the handle (1) such that the top surface of the third element (3) is flush with or below the end surface (X) of the handle (1).

The body (14) of the third element (3) can have any kind of cross-section.

The fastening screw (7) is screwed by threads (15) of its body (16) into the body (14) of the third element (3), and it must directly/indirectly abut against the implement (2). In this case, (FIG. 1) it abuts indirectly by means of the stop washer (5). Wherefore, the fastening screw (7) passes through the stop washer (5), and the head (9) of the fastening screw (7) abuts against this stop washer (5), and between the two, there is a constant traction washer (6) or other mechanical means of traction, for example a spring, an elastic plate, etc.

The fastening screw (7) can be tightened more or less, and the gaps that occur between the head of the handle (1) and the implement (2) in the hole (11) can be corrected.

The threads (15) of the fastening screw (7) in the body (14) of the third element (3) are outfitted with self-locking piece (4), for example of plastic.

As a supplementary element, there is an anti-rotation pin (8) between the stop washer (5) and the third element (3), as in FIG. 1), but it could be positioned between the stop washer (5) and the head of the handle (1). It could likewise be positioned between the implement (2) and the head of the handle (1), or on several of these elements at the same time.

The anti-rotation pin (8) can be substituted by a key or other equivalent mechanical element.

The material of the third element (3) is different from the material of the head of the handle (1). For example, the head of the handle (1) is wood or a synthetic material, and the third element (3) is metallic, or both elements can be non-metallic.

Usually, the implement (2) itself is made of metal.

It can be observed in FIG. 2 how the head (9) of the fastening screw (7) abuts directly against the implement (2). The body (16) of the fastening screw (7) goes through a second through-hole (17) made in the implement (2), and it is screwed directly into the head of the handle (1).

Similarly to what is described in FIG. 1, there is a constant traction washer (6), a self-locking piece (4) and an anti-rotation pin (8).

A cavity (18) has been made in the implement (2) in order to recess the head (9) of the fastening screw (7).

In order to provide a better fastening of the element (3) on the head of the handle (1), and positioned between them, there are one or various (expandable) lock washers (20) (for example), retaining clips or equivalent mechanical element, which prevent the threads (13) of the third element (3) from rotating in the head of the handle (1) and which function as an axial stop against the head of the handle (1), thereby preventing the third element (3) from detaching from the head of the handle (1).

An expansion washer (20) guarantees that, even in the event that the threads (13) break, the third element (3) will not detach from the head of the handle (1) or, in other words, that the implement (2) will detach from the head of the handle (1).

An extractor element (25) (for example, an expansion washer) can be positioned in the cavity (18) so that, when unscrewing the tightening screw (7) but without coming out of the cavity (18), extraction force can be applied to the extractor element, which thus separates the implement (2) from the head of the handle (1)—FIG. 2.

Figure 3:
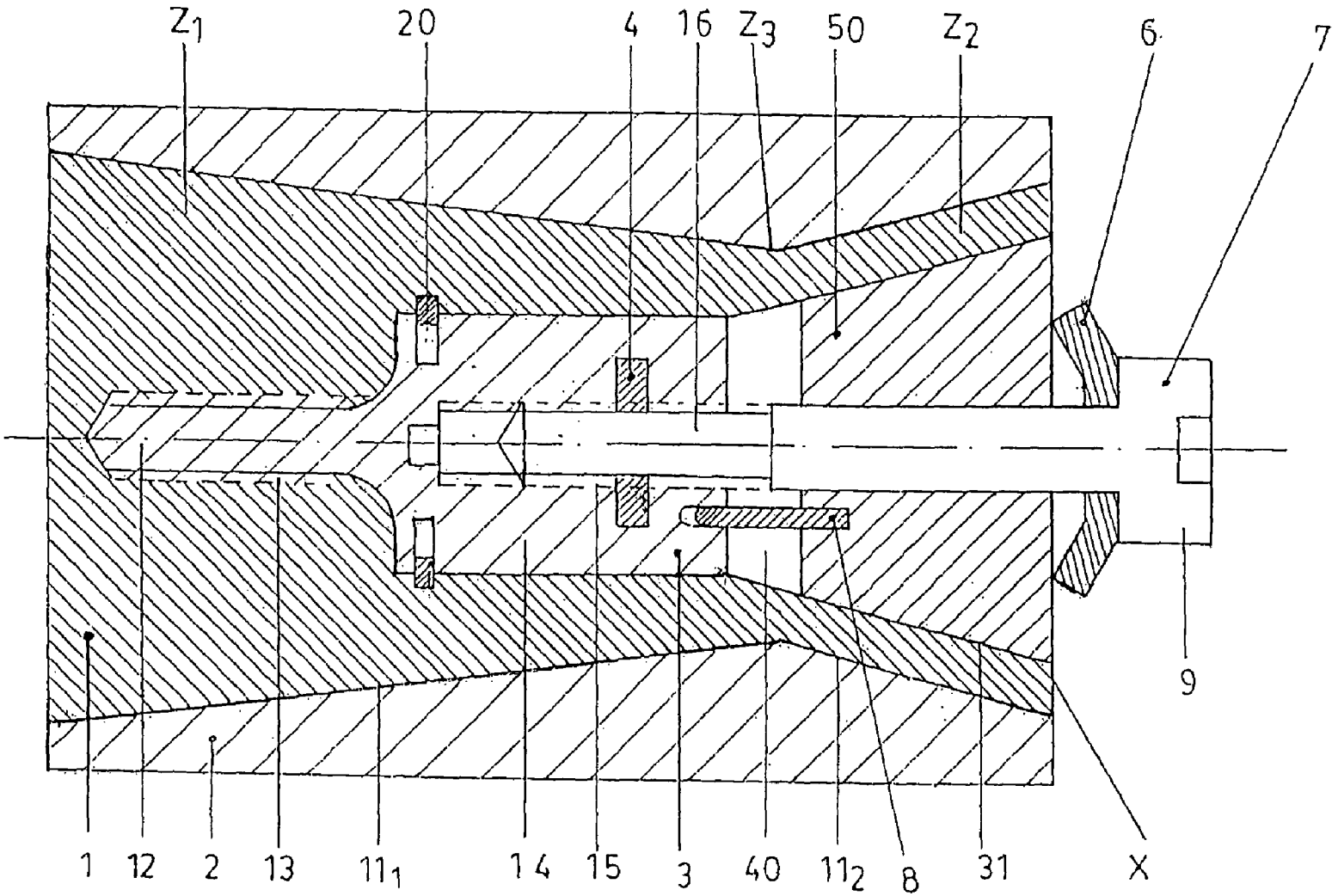
FIG. 3 is a longitudinal, cross-section view of a practical execution of the connection, object of the invention, with a biconical handle (1)

In the execution presented in FIG. 3, the through-hole presents an inlet zone ($\mathbf{11}_1$) and an outlet zone ($\mathbf{11}_2$), which are convergent surfaces towards the center of the through hole (for example, two sections of a cone, pyramid sections, etc., with any kind of cross section, for example circular, elliptical or polygonal).

The handle head (1) presents an incoming angle zone ($Z_1$) and an outgoing angle zone ($Z_2$) whose exterior surfaces are fitted flush with those that are presented by the corresponding surfaces of the through-hole (once the wedge (50) has acted as explained below).

The handle head (1) remains inserted in the through-hole.

A bottom hole is made (40) in the head of the handle (1), which has a wedge (50) at the outlet (31).

Preferably, the outgoing angle zone ($Z_2$) presents a groove or expansion zone that makes it possible for it to penetrate into/be introduced through the minimum radius ($Z_3$) of the through-hole, whereby the outgoing angle zone ($Z_2$) is positioned in the outlet zone ($\mathbf{11}_2$) of the through-hole, and it is adjusted to this outlet surface ($\mathbf{11}_2$) by means of the wedge (50), which is conical shaped, for example. The outgoing angle zone ($Z_2$) is deformable, expandable.

The fastening screw (7) is screwed by thread (15) of its body (16) into the body (14) of the third element (3), and it must directly/indirectly abut against the implement (2). In this case, (FIG. 3) it abuts directly by means of the wedge (50). Wherefore, the fastening screw (7) passes through the wedge (50), and the head (9) of the fastening screw (7) abuts against this wedge (50). Between them, the initial means of traction are provided, such as a constant traction washer (6) or other mechanical means of traction, for example a spring, an elastic plate, etc.

The fastening screw (7) can be tightened more or less, and the gaps that occur between the head of the handle (1) and the implement (2) in the through-hole can be corrected, thereby creating a fitted connection along the entire friction zone between the implement (2), the head of the handle (1) and the wedge (50).

Figure 4:
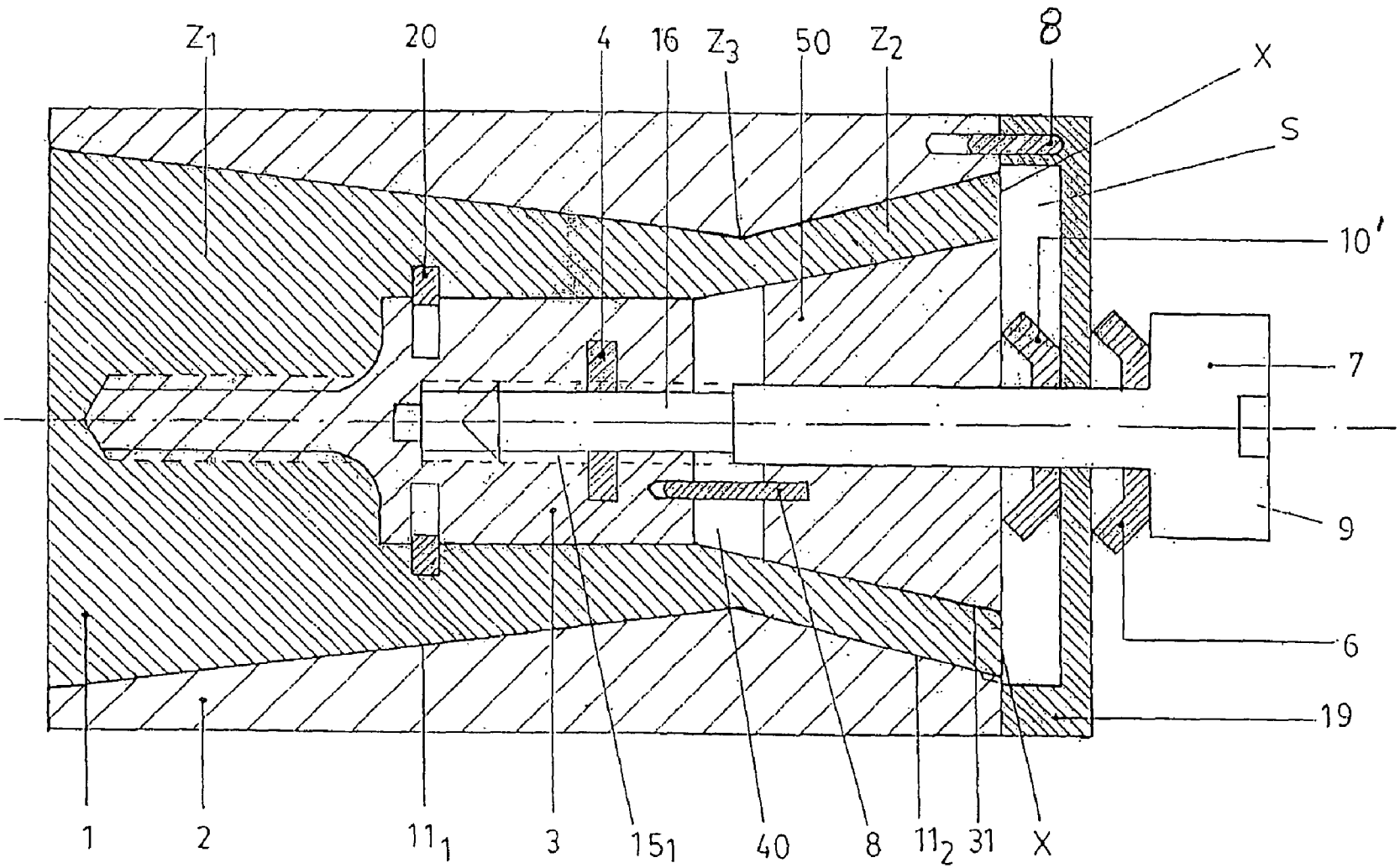
FIG. 4 is a longitudinal, cross-section view of another practical execution of the object of the invention, with a biconical handle (1)

FIG. 4 shows a stop washer (19) fastened to the implement (2), some initial means of traction (6) between the head (9) of the rotation screw (7) and the stop washer (19). This causes a constant traction force, for example, between the implement (2) and the incoming angle zone ($Z_1$) of the head of the handle (1) and some secondary means of traction (10') between the stop washer (19) and the wedge (50). This creates a constant traction force, for example, between the implement (2) and the outgoing angle zone ($Z_2$) of the handle head (1) by means of the wedge (50), meaning that there are adjustment forces in both conical zones ($Z_1$ and $Z_2$).

A self-locking piece (4), for example of plastic, is positioned on the threads ($\mathbf{15}_1$) of the fastening screw (7) on the body (14) of the third element (3).

As a supplementary element, there is an anti-rotation pin (8) between the wedge (50) and the third element (3), as in FIGS. 3 and 4, but it could be positioned between the wedge (50) and the head of the handle (1), between the stop washer (19) and the implement (2) and also between the implement (2) and the head of the handle (1), or on several of these elements at the same time.

Figure 5:
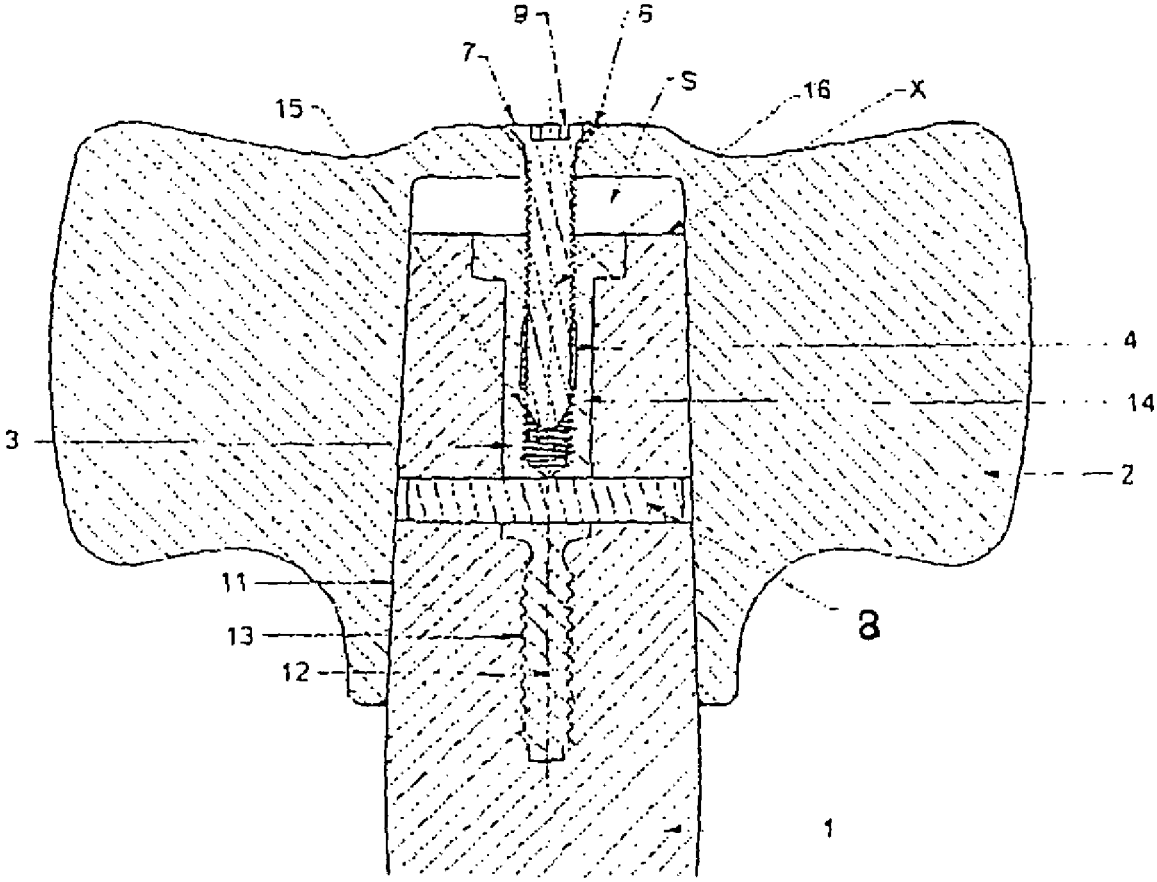
FIG. 5 is a longitudinal, cross-section of a practical execution of the connection, with a screw abutting the implement.

In another variation, shown in FIG. 5, the head (9) of the fastening screw (7) abuts directly against the implement (2), and anti-rotation pin (8) prevents rotation of insert 3 in handle (1).

The object of the invention includes combining the existence of the third element (3) with the fact of making the head (9) of the fastening screw (7) or a similar element abut directly against the implement (2) or an intermediate element such as a stop washer (19 and 5) or a wedge (50) and using one or various traction elements between them in order to achieve a continuous fit between the biconical head of the handle and the biconical hole of the implement.

In all the variations, the end surface (X) of the head of the handle (1) remains free such that there is substantially a space (S) that allows it to move longitudinally.

The head of the handle (1) might not reach the bottom of the hole (11), but rather it leaves a space that allows the longitudinal movement of the head of the handle (1) in order to or, as it can be seen in FIGS. 1 and 4, free space (S) remains between the end surface (X) and the stop washer (19 and 5).

In any event, the head of the handle (1) should work as a nut with respect to the fastening screw (7).

What we claim is:

1. A handle connection for a manual tool, comprising:

a) a handle for a manual tool head, said handle having a non-metallic head with outer side walls that are conical or biconical in shape, an end surface and a blind hole that extends axially into the head of the handle from the end surface;

b) the manual tool head having a through hole with inner side walls that are conical or biconical in shape and a free space on top of the end surface of the head of the handle when the head of the handle is inset in the through hole of the manual tool head and the manual tool head is assembled on the handle the conical or biconical outer side walls of the handle match corresponding conical or biconical inner side walls of the through hole of the manual tool head so that the head of the handle fits flush with the through hole of the manual tool head;

c) a mating, metallic and non-deformable element positioned in the blind hole of the handle and fastened to the head of the handle, wherein the mating element is completely contained within the head of the handle and isolated from the manual tool head the mating element having a blind hole coaxial therein; and d) a fastening screw having a body which is screwed into the blind hole of the mating element to connect the screw to the mating element and the screw has a head that abuts against the manual tool head, thereby establishing a male-female relationship between the mating element and the fastening screw such that the mating element can move longitudinally, thus pulling the head of the handle further into the through hole of the manual tool head reducing the free space on top of the end surface of the handle.

2. The handle connection of claim 1, wherein:

a) the through hole in the manual tool head is biconical having an inlet zone and an outlet zone and the surface of the outlet zone, at least, converges towards the interior of the through hole;

b) the outer side walls of the head of the handle is biconical having an incoming angle zone and an outgoing angle zone, the exterior surface of the incoming angle zone matches the corresponding surface of the inlet zone of the through hole;

c) a wedge in an outlet of the blind hole of the handle, such that when pressure is applied to the wedge, the exterior surface of the outgoing angle zone is forced to fit flush to the corresponding outlet zone of the hole;

d) the body of the fastening screw passes through the wedge to connect to the mating element.

3. The handle connection of claim 2, wherein an initial mechanical means of traction is positioned between the head of the fastening screw and the manual tool head.

4. The handle connection of claim 3, wherein the head of the fastening screw abuts directly against the manual tool head by means of the wedge.

5. The handle connection of claim 3, wherein the head of the fastening screw abuts directly against the manual tool head by means of a stop washer, which is fastened to the manual tool head at the outlet of the through-hole.

6. The handle connection of claim 4, wherein the initial mechanical means of traction is positioned between the head of the fastening screw and the wedge.

7. The handle connection of claim 5, wherein the initial mechanical means of traction is positioned between the head of the fastening screw and the stop washer.

8. The handle connection of claim 7, wherein a secondary mechanical means of traction is positioned between the wedge and the stop washer.

9. The handle connection of claim 7, wherein an anti-rotation pin is positioned between the manual tool head and the stop washer.

10. The handle connection of claim 5, wherein an anti-rotation pin is positioned between the mating element and the stop washer.

11. The handle connection of claim 5, wherein an anti-rotation pin is positioned between the head of the handle and the stop washer.

12. The handle connection of claim 2, wherein the through hole, the head of the handle, the mating element and the wedge are coaxial.

13. The handle connection of claim 1, further comprising a self-locking piece in the blind hole of the handle that locks the threads of the fastening screw to the mating element.

14. The handle connection of claim 1, wherein the mating element has an extension that penetrates deeply into the head of the handle.

15. The handle connection of claim 3 wherein an anti-rotation pin is positioned between the manual tool head and the head of the handle.

16. The handle connection of claim 1, wherein at least one expansion washer is positioned between the mating element and the head of the handle, which performs an anti-rotation function on the mating element in the head of the handle, and acts as an axial stop for the mating element against the head of the handle, thereby preventing the mating element from becoming detached from the head of the handle.

17. The handle connection of claim 1, wherein the manual tool head has a cavity in the through hole that hides the head of the fastening screw.

18. The handle connection of claim 1, wherein the head of the fastening screw abuts directly against the manual tool head.

19. The handle connection of claim 1, wherein an anti-rotation pin is positioned between the head of the handle and the mating element.

* * * * *